US007427303B2

(12) United States Patent
Sarin et al.

(10) Patent No.: US 7,427,303 B2
(45) Date of Patent: Sep. 23, 2008

(54) SURFACTANT COMPOSITION INCLUDING ETHOXYLATE OF CNSL

(75) Inventors: Rakesh Sarin, Faridabad (IN); Deepak Kumar Tuli, Faridabad (IN); Shanti Parkash, Faridabad (IN); Krishan Kumar Swami, Faridabad (IN); Rajiv Ranjan, Faridabad (IN); Ram Prakash Verma, Faridabad (IN); Niranjan Raghunath Raje, New Delhi (IN); Akhilesh Kumar Bhatnagar, Faridabad (IN)

(73) Assignee: Indian Oil Corporation Limited, Mumbai, Maharashtra (IN)

( * ) Notice: Subject to any disclaimer, the term of this patent is extended or adjusted under 35 U.S.C. 154(b) by 688 days.

(21) Appl. No.: 10/494,385

(22) PCT Filed: Aug. 27, 2002

(86) PCT No.: PCT/IN02/00172

§ 371 (c)(1),
(2), (4) Date: Oct. 12, 2004

(87) PCT Pub. No.: WO2004/020554

PCT Pub. Date: Mar. 11, 2004

(65) Prior Publication Data

US 2005/0022445 A1 Feb. 3, 2005

(51) Int. Cl.
*C10L 1/32* (2006.01)

(52) U.S. Cl. ..... 44/301; 44/307

(58) Field of Classification Search ..... 44/301, 44/307

See application file for complete search history.

(56) References Cited

U.S. PATENT DOCUMENTS

| | | | | | |
|---|---|---|---|---|---|
| 2,531,502 | A | | 11/1950 | Groote et al. | 260/521 |
| 4,233,194 | A | * | 11/1980 | Eschwey et al. | 528/163 |
| 4,744,796 | A | * | 5/1988 | Hazbun et al. | 44/302 |
| 5,006,271 | A | * | 4/1991 | Avery et al. | 508/226 |
| 5,551,956 | A | * | 9/1996 | Moriyama et al. | 44/301 |
| 2001/0005955 | A1 | * | 7/2001 | Langer et al. | 44/301 |
| 2002/0014033 | A1 | | 2/2002 | Langer et al. | 44/301 |
| 2002/0066225 | A1 | | 6/2002 | Puri et al. | 44/307 |

FOREIGN PATENT DOCUMENTS

| | | | |
|---|---|---|---|
| EP | 0915097 | | 5/1999 |
| WO | WO 93/18117 | * | 7/1993 |

* cited by examiner

*Primary Examiner*—Glenn Caldarola
*Assistant Examiner*—Jim Goloboy
(74) *Attorney, Agent, or Firm*—Allen Dyer Doppelt Milbrath & Gilchrist

(57) ABSTRACT

The present invention relates a surfactant composition for use as an emulsifier in water blended fuel mixture. The said composition includes ethoxylate of cashew nut shell liquid. In addition ethoxylate of cashew nut shell liquid, the said composition comprises a co-surfactant having a hydrophilic lipophilic balance in the range of 4 to 12 and a polymeric dispersant. The water blended fuel mixture using emulsifiers of the present invention, overcome some of the shortcomings of the previously known emulsions. The ethoxylate of cashew nut shell liquid is of the formula (I).

(I)

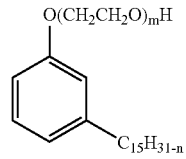

23 Claims, No Drawings

SURFACTANT COMPOSITION INCLUDING ETHOXYLATE OF CNSL

FIELD OF THE INVENTION

This invention relates to surfactant composition including ethoxylate of CNSL for use as an emulsifier in water blended fuel compositions and more particularly to water fuel emulsified compositions.

BACKGROUND OF THE INVENTION

Conventional diesels, derived from crude petroleum, are used in a variety of applications, such as in transportation, power generation etc. However, the diesel run vehicles and other stationary equipments are associated with pollution, specially smog forming nitrogen oxides ($NO_x$) emissions and particulate matter (PM) or soot. This environmental concern has been the main guiding factor for research in finding the economical solutions that could reduce pollution emitted from diesel-powered engines. Several chemical additive approaches have been tried in past with the main object of reducing emissions from existing engines, new and old, without expensive engine modifications or replacements. It is known in the literature that internal combustion engines can be run on mixture of water and fuel to produce lower $NO_x$, hydrocarbon and particulate emissions per unit of power output. Water is inert towards combustion, but acts to lower peak emission temperatures, which result in significant reduction of $NO_x$ formation. Though water can also be separately injected into the combustion chamber, but the hardware costs are high. Water can however be added to fuel as an emulsion, but the stability of emulsion has historically been a problem. The problems of making water-fuel emulsions include instability of emulsions, high cost of emulsifiers, larger amounts of emulsifiers required to produce the emulsions and non-availability of non-toxic biodegradable emulsifiers.

Due to the concerns about the emissions from diesel run engines, several options have been explored and these include engine modifications and modifications in the fuels. Alcohol and water have been studied in details as their addition in fuel could reduce emissions from the engines to an appreciable extent.

Publication No., WO 97/34969 describes stable a diesel-water emulsion by using a surfactant system consisting of sorbitan sesquioleate, a polyethylene glycol mono-oleate and a nonylphenol ethoxylate. The surfactant system had a HLB of 6-8.

WO 48123,2001 of ElfANTAR, France describes an emulsifying system to make stable hydrocarbon-water emulsion. The system contained a sorbitol ester, polyethoxylated fatty acid ester and poly alkoxylated alcohols.

A Hungarian, PCT application No. WO 12285,1998 described water containing fuel compositions useful for internal combustion engines. An emulsifying system was disclosed and it essentially consisted of coconut fatty acid ester, polyethylene glycol derivatives of coconut oil fatty acid esters, sodium lauryl sulphate and glycerin. The amount of emulsifying mixture was in the range of 5-15% for dispersing 10-40% distilled water in the hydrocarbon fuel.

Several other emulsifying systems useful for incorporation of water in hydrocarbon have been described e.g. U.S. Pat. No. 4,729,769; U.S. Pat. No. 4,594,111; U.S. Pat. No. 4,100,097; U.S. Pat. No. 5,021,183; U.S. Pat. No. 5,443,757 & U.S. Pat. No. 4,917,883. A European patent application EP 1152049,2001 discloses a method for preparing water in hydrocarbon micro emulsion by use of a surfactant. Both micro & macro emulsions could be prepared depending upon the amount of water to be dispersed and the type of emulsifying additives. Thus, micro emulsion were reported utilizing 5% volume of water in diesel and the surfactant package consisted of lipophilic neat oleic acid, lipophilic ethoxylated oleic acid, lipophilic sorbitan ester monoleate, lipophilic ethoxylated oleic acid and a hydrophilic oleic acid completely neutralized with monoethanol amine. The application of the above surfactant system resulted in micro emulsions but it required 8% volume of the surfactant mixture and intense mechanical agitation. For incorporation of 10% volume water into the diesel phase, 14% volume of the surfactant mixture and intense manual agitation was necessary. Even 15% water could be micro emulsified in diesel, however very large dose of surfactant mixture (20% volume) was required. Similarily, several other patents describe the formation of stable micro emulsion of water and hydrocarbon fuel, which at times have larger amounts of surfactants as compared to the water content. Efforts in the area of the micro emulsion of water in hydrocarbon fuels are described in U.S. Pat. No. 5,743,922, WO 34969(97); U.S. Pat. No. 5,873,916, WO 13031(99).

Inspite of the disclosures of above patents, the micro emulsified water containing hydrocarbon fuels could not gain commercial popularity, as the emulsions, which are suitable as combustible fuel, need very large amounts of surfactants and/or other stabilizing agents. In view of these limitations of the micro emulsions a lot of research work has been carried out and reported for formation of stable cost effective micro emulsions of water in hydrocarbon fuels.

In order to reduce the amount of the surfactants and/or stabilizers and yet to get the micro emulsified fuels, a tri component system has also been explored. Wanzel et.al (U.S. Pat. No. 4,083,698) prepared a stable water in oil micro emulsions comprising (a) a hydrocarbon fuel (b) water, (c) an alcohol, and (d) a combination of surface-active agents. Examples given include diesel fuel micro emulsions where in the alcohol is methanol, ethanol or isopropanol.

The combination of surfactant must include three components (1) a long chain fatty acid salt (2) a free fatty acid, preferably long-chains unsaturated fatty acid and (3) a non-ionic surfactants like ethylene oxide condensation products and esterified products of fatty acids with ethylene oxide. A. W. Schwab in a U.S. Pat. No. 4,451,265 disclosed the formation of a hybrid fuel—a micro emulsion prepared from diesel fuel, water, alcohol and a surfactant comprising N,N-dimethylethanolamine and a long chain fatty acid derivative.

Emulsified water-hydrocarbon fuel compositions have been described in several patents. Thus, Daly et al (U.S. Pat. No. 6,280,485, 2001) describes water blended fuel compositions comprising: (A) a hydrocarbon boiling in gasoline or diesel range; (B) water; (C) a minor emulsifying amount of at least one fuel soluble salt made by reacting at least one acetylating agent having about 16-500 carbon atoms with ammonia or at least one amine and (D) a water soluble, ashless, halogen, boron, phosphorous free amine salt distinct from component C. In some formulations a co-surfactant, organic cetane improver and anti-freeze may also be used.

European patent EP $0561600A_2$(1993) discloses water fuel emulsions in which the emulsifier is made by reaction of (A) substituted acetylating agent and (b) ammonia and/or at least one amine. A U.S. Pat. No. 4,078,753(1987) discloses water in oil emulsion comprising (A) continuous oil phase; (B) water; (l) at least one hydro carbonyl substituted carboxylic acid & anhydride, ester or amide derivative of said acid or anhydric and (C) (II) at least one amine; and (D) an effective amount of at least one water soluble, oil-insoluble functional additive.

Several other patents, which describe the formation of water hydrocarbon emulsions, include U.S. Pat. No. 5,047,175; EP 0475620B1 U.S. Pat. No. 5,669,938: U.S. Pat. No. 6,017,368.

CNSL and its derivatives have been known for producing high temperature phenolic resins and friction elements, as exemplified in U.S. Pat. Nos. 4,395,498 and 5,218,038. Cashew nut shell liquid occurs as a reddish brown viscous liquid in the soft honeycomb structure of shell of cashew tree, Anacardium Occidentale L. Native to Brazil, the tree grows in the coastal areas of Asia and Africa. Cashew nut attached to the shell apple is gray colored kidney shaped and 2.5-4 cm long. The shell is about 0.3 cm thick, having a soft leathery outer skin and a thin hard inner skin. Between these skins is the honeycomb structure containing the phenolic material popularity called CNSL. Inside the shell is kernel wrapped in a thin brown skin, known as the testa. The nut thus consists of kernel (20-25%), the shell liquid (20-25%) and testa (2%), the rest being the shell. CNSL, extracted with low boiling petroleum ether, contains about 90% anacardic acid and about 10% cardol. CNSL, on distillation, gives the yellow phenolic derivatives, which are a mixture of biodegradable unstructured unsaturated m-alkylphenols, including cardanol. Catalytic hydrogenation of these phenols gives a white waxy material, predominantly rich in tetrahydrocardol.

Friction lining production from CNSL is also reported in U.S. Pat. No. 5,433,774. Likewise, it is also known to form different types of friction materials, mainly for use in brake lining system of automobiles and coating resins. U.S. Pat. No. 6,229,054 describes a process for hydroxyalkylation of cardanol with cyclic organic carbonates. CNSL derivatives have also been used for metal extraction, as exemplified in U.S. Pat. No. 4,697,038. In another U.S. Pat. No. 4,352,944, Mannich bases of CNSL have been described.

However, the first application of CNSL in making lubricating oil additives was disclosed by us in U.S. Pat. Nos. 5,910,468 and 5,916,850. U.S. Pat. No. 6,339,052 also describes lubricant compositions for internal combustion engines based on additives derived from cashew nut shell liquid.

SUMMARY OF THE INVENTION

The problem addressed by the present invention was to develop a surfactant composition for use as an emulsifier in water blended fuel mixture.

A further object of the invention was to propose a surfactant composition which was effective at lower dosage. A still further objective was to minimise the cost of making the emulsified fuel water stable emulsions by selecting appropriate inexpensive raw materials. Development of an emulsifier based on naturally occurring, biodegradable and abundantly available cashew nut shell liquid was also an objective of this invention so as to make available stable water emulsified fuel compositions suitable for internal combustion engines at much reduced cost.

To achieve the said object, the present invention provides a surfactant composition for use as an emulsifier in water blended fuel mixture comprising a) 5-65% by weight of an ethoxylate of cashew nut shell liquid of the formula

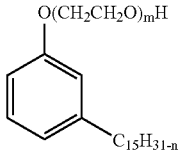

where m=1-12 and n = 0, 2, 4 & 6.

b) 1-15% by weight of a cosurfactant having a hydrophilic lipophilic balance in the range of 4 to 12 and c) 15-50% by weight of a polymeric dispersant The present invention further provides a water fuel emulsified composition comprising 55-96% by weight of a hydrocarbon fuel in the gasoline-diesel range, 3-35% by weight of water and 0.05-27% by weight of a surfactant composition and the balance if any additives such as cetane booster, corrosion inhibitor.

Preferably, the amount of hydrocarbon fuel in the gasoline-diesel range is 88% by weight, the water component is 10.4% by weight and 1.6% by weight of the surfactant composition of the present invention. More preferably, the amount of hydrocarbon fuel in the gasoline-diesel range is 81.8% by weight, the water component is 16.2% by weight and 2% by weight of the surfactant composition of the present invention.

DETAILED DESCRIPTION OF THE INVENTION

The present invention is concerned with emulsions of hydrocarbons and water, and emulsifying additives suitable for forming such emulsions. It is known that emulsions of hydrocarbon and water can be formed using large number of different emulsifiers.

One component of the composition of this invention is hydrocarbon fuel boiling in the gasoline or diesel range. The diesel fuels that are useful with this invention can be any type of diesel fuel defined by ASTM-D 396. The sulfur content of the diesel fuel may be as low as 50 ppm or as high as 0.25% by weight. Any type of diesel fuel with suitable viscosity and boiling range can be used in the present invention and may also contain usual additives like detergent-dispersant, antioxidant, cetane improver, stabilizers etc. The gasoline useful in the present invention are motor gasoline covered under ASTM439-89 specification and may contain usual performance additives like antioxidant, stabilizer, octane booster, MFA etc.

The water phase for use in making emulsions in accordance with the present invention can suitably be formed any acceptable water source, and is preferably water, which is available in sufficient quantities and at inexpensive cost. For example a suitable water phase could be water such as 150-ppm brine. Other sources, which give water of acceptable characteristics, can be used in the invention.

The surfactant package of the present invention forms an important part of the present invention. The surfactant package of the present invention is preferably a package, which includes both a hydrophilic surfactant component and lypophillic surfactant component. The combination of these surfactant components is so selected so as to reduce the amount of total surfactant by synergetic action while providing the stable emulsions.

The surfactant package of the present invention essentially contains three components i.e. A) a surfactant derived from cashew nut shell liquid; B) a co-surfactant and C) a polymeric dispersant. The chemical compounds suitable for each of these types are explained.

A Surfactant Derived From Cashew Nut Shell Liquid

The inventive surfactant consist of ethoxylates of technical or hydrogenerated cashew nut shell liquid (CNSL), or the mixtures thereof.

It has now been surprisingly observed that ethoxylated CNSL is a very potent stabilising emulsifier useful for making stable water containing fuel emulsions which are suitable as fuel in internal combustion engines. The natural or hydrogenated CNSL are ethoxylated using a known ethoxylating agent, such as ethylene oxide. The overall degree of ethoxylation of CNSL is varied by controlling the ratio of cashew nut shell liquid and ethylene oxide, the reaction temperature and pressure. Higher degree of ethoxylation results in better water solubilisation capacity, which is desirable. However very high degree of etlhoxylation leads to solidification of the product and therefore intermediate ethoxylation is desirable. It has been discovered in the present invention that CNSL having an ethoxylation content of 6 to 14 is most suitable for use as the stabilising additive for making stable water emulsified fuel compositions. The ethoxylated CNSL of the present invention is far superior in emulsification efficacy vis-à-vis commercially available emulsifiers. The higher efficacy of ethoxylated CNSL has resulted in its lower dosage and thus better cost-economics.

Industrial CNSL is generally dark brown in colour, which may be disadvantageous in some applications. The purification of CNSL for colour improvement has been described in U.S. Pat. No. 4,697,038. However, it was found that ethoxylates made directly from technical grade CNSL were of acceptable colour and for the present application no treatment in colour improvement was necessary.

The capability of technical CNSL ethoxylates to act as solubilising additive for making stable hydrocarbon fuel—water emulsions has been observed for the first time. This observation is of particular importance as it will bring down the cost of stabilising additive to a very significant level as the basic material, i.e., CNSL is of low cost and abundantly available. A high degree of biodegradability of CNSL ethoxylates is an additional desirable benefit.

B Co-Surfactant

These co-surfactants, a type of emulsifiers, are non-ionic compounds, having a hydrophilic lipophilic balance i.e. HLB in the range of 4 to 12. Chemically these co surfactants may be of the type, which includes alcohol ethoxylates, ethoxylated phenols, ethoxylated amines, ethoxylated fatty esters, glycol esters, mono/di or tri glycerides, ethoxylated fatty acids etc. However, ethoxylated alcohols and phenols are the preferred co surfactants.

Ethoxylated alcohols have been used in past as a stabilising emulsifying additives for making water containing fuel compositions. For example, a U.S. Pat. No. 6,080,716 of 2000 describes a surfactant, which is made by reaction of aliphatic alcohol with ethylene oxide. The non-ionic ethoxylated surfactant, as emulsifying additives are prepared from reaction of aliphatic alcohol with ethylene oxide and are also available commercially.

In one embodiment, the cosurfactant is ethoxylated linear alcohol nonionic type with varying alcohol chain and ethoxylation content. These are available commercially as Tomah products, under the name "Tomadol". These have the general chemical representation as $RO(CH_2CH_2O)nH$, where R is mostly linear alkyl chain and n may vary from 2.5 to about 12, preferably from 2.5 to 7. These ethoxylates are generally in the molecular weight range of 280 to 590 and the ethylene content (wt %) varies from 35 to 70. The advantage of using "Tomodols" include the preferred range of HLB values of 4 to 12 and acceptable flash points which are in the range of 140-248° C.

The lower "Tomodols" are liquids at ambient temperature having melting range of −25 to 11° C. and viscosity in the range of 12 to 34, cst at 100° F. The most preferred "Tomodol" type of ethoxylated alcohols are 91-2.5, 1-3, 23-3 and 25-3and some of the critical physicochemical properties of these compounds are given below.

| Product | EO Groups/ Avg | Mol. weight | EO Wt. % | Melting range ° C. | Sp. gravity 25° C. | Vis. Cst 100° F. | Hydroxyl no. mgKOH/g | Flash pt. ° C. | Pourpt. ° C. | HLB |
|---|---|---|---|---|---|---|---|---|---|---|
| 91-2.5 | 2.7 | 281 | 42.3 | −25 to −17 | 0.925 | 12 | 200 | 124 | −13 | 8.5 |
| 1-3 | 3 | 305 | 43.3 | −15 to 4 | 0.936 | 10 | 184 | 142 | −7 | 8.7 |
| 23-3 | 2.9 | 322 | 39.6 | −4 to 6 | 0.922 | 14 | 174 | 152 | 1 | 7.9 |
| 25-3 | 2.8 | 330 | 37.3 | 2 to 11 | 0.921 | 19 | 170 | 157 | 3 | 7.5 |

The other type of alcohol ethoxylates usefuil as co surfactant are available from Shell Petroleum Company Lulder the name of "NEODOL™". One of the useful product of this series is "NEODOL™ 91-2.5E" which has a hydroxyl number of 202-14 (mg KOH/g); with a average molecular weight of 280 and ethylene oxide content of 42.3% (wt). It had pour point of −20° C., flash point 120° C., density of 0.911 (g/ml) and a HLB value of about 8.5.

C Polymeric Dispersant

The polymeric dispersant essentially consists of the reaction product of an acetylating agent and amine. The acetylating agents include carboxylic acids, acid halides; anhydrides and esters. These acetylating agents may have alkyl substitution of about 12 to 250 carbon atoms. The preferable acetylating agents are dicarboxylic acids and their corresponding anhydrides and the most preferable acetylating agents are hydrocarbyl substituted succinic acids or anhydrides. The alkyl substitution of the acetylating agents could be derived from alpha olefins, polyisobutene or other such hydrocarbyl substituents. The preferred alkyl substituents are polyisobutene having the number average molecular weights of 500 to 1300. The suitable alkylated acetylating agents are reacted with amines, hydroxylamines or polyamines. The suitable amines are ethylene polyamines.

Many of the surfactants of the chemical type described above are available from commercial sources. In one such embodiment, the dispersant is a poly isobutene succinimide available from Lubrizol Corporation. The products useful as dispersants in the present invention include LZ-6418, having N content of 1.6-2.1% and viscosity at 210° F. of 250-310 Cst.

In one embodiment, ashless dispersants available from Ethyl corporation under the trade name "HITEC" were used. These dispersant have nitrogen content of 1.8-2.2% wt and viscosity at 210° F. in the range of 340-410 Cst. The particularly useful dispersant in present invention include "HITEC- 644", "HITEC-648". Other useful commercial dispersant of the polyisobutene succinimide type are those supplied by SINOPEC, China and useful component include "T151" & "T152". Similarly, other commercially available polyisobutene succinimide of appropriate nitrogen content and molecular weight may also be used in the present invention.

Other Optional Additives

Cetane index is the measure of combustibility of diesel fuel in the internal combustion engine. The value of cetane number is generally specified in the commercial specification of fuel and are different for different countries. In India e.g the minimum cetane number is 48.

The water-emulsified fuels generally fall short in the cetane number, as water does not contribute to the overall cetane of the emulsified fuel. However, the cetane number of water emulsified fuel can easily be boosted by adding small amount of cetane booster.

Organo nitrates e.g. isopropyl nitrate or 2-ethylhexyl nitrates which are available commercially are suitable to enhance the cetane of the ethanol blended hydrocarbon fuel. The amount of cetane booster present in the fuel emulsion is the function of cetane value of the particular diesel fuel and the amount of water present in the particular fuel composition. Generally, lower the diesel fuel cetane valtie, higher the amount of the cetane booster. Similarly, because water typically acts as a cetane depressant, the higher the concentration of water in the emulsified fuel, more is the concentration of cetane booster.

Higher amount of dissolved water in the water-emulsified fuels may cause corrosion to the metallic parts especially on the fuel side components. This problem could be easily controlled by addition of corrosion inhibitors. Several classes of corrosion inhibitors are known for use in fuels. However, it has been found that mercapto thiadiazole derivatives as described in U.S. Pat. No. 6,362,137 were the most effective in these fuels. For hydrocarbon fuels, containing upto 35% of water, an addition of 0.001 to 0.03% volume of the mercapto thiadiazole described in U.S. Pat. No. 6,362,137 are sufficient to provide necessary anti corrosion properties.

The fuel composition of the invention provides a number of benefits. For example, the fuel composition remains stable over the range of temperatures (from the pour point of diesel to about +50° C.) which covers both summer and winter conditions. The fuel also meets the minimum cetane number requirement as laid in the diesel fuel specification and the fuel emulsions can be prepared within minutes without the need of expensive and energy intensive fuel blending equipment. Since the blended fuel has lower sulphur and aromatics as compared to the parent diesel, the tail pipe sulphur emissions are low.

EXAMPLES

The following examples are provided to further illustrate the invention, but are not intended to limit the scope of the invention. Specifically, the following examples are provided to illustrate the formation of stable water blended fuel co positions, which are suitable for use in internal combustion engines.

Example-1

Diesel fuel (560 ml) is placed in a one liter flask at ambient temperature (20-25° C.) and to this was added component A {7.0 g }, B {0.1 g } and component C {8.0 g }. The contents of flask were subjected to ultrasonic vibration using a sonicator set at frequency of about 20 KHz. Homogenous phase could be obtained in less than a minute. Water {40 ml } was then added in one lot and the mixture further sonicated for about 30 sec. Thereafter, diesel {340 ml} followed by water {40 ml} was added and the mixture further sonicated for 30 sec. A part of the emulsion thus obtained was transferred to a 500 ml glass cylinder.

The emulsion was visually examined every 24 hrs for any separation either on top or at the bottom of cylinder with in 20 days which implied unstable emulsion and was rejected. Additionally the emulsions were examined by low resolution NMR for the quantity of water in the emulsion form and the water present in the free form.

Examples 2-12

Following the general procedure as described for example-1, the following stable water-blended fuel compositions were made. The amounts given indicate parts by weight. These emulsions were stable for at least 20 days.

| | Example No | | | | | | | | | | |
|---|---|---|---|---|---|---|---|---|---|---|---|
| | 2 | 3 | 4 | 5 | 6 | 7 | 8 | 9 | 10 | 11 | 12 |
| Diesel | 90 | 88 | 84.2 | 81.8 | 79.0 | 74.3 | 95 | 93 | 66.7 | 74 | 67.1 |
| Water | 8.5 | 10.4 | 14.0 | 16.2 | 18.6 | 23.2 | 4.2 | 6.0 | 28.0 | 19.9 | 23.1 |
| Component A | 0.7 | 0.8 | 0.9 | 1.0 | 1.35 | 1.6 | 0.45 | 0.6 | 3.1 | 1.25 | 3.4 |
| Component B | 0.1 | 0.1 | 0.15 | 0.2 | 0.25 | 0.25 | 0.05 | 0.1 | 0.6 | 2.25 | 2.6 |
| Component C | 0.7 | 0.7 | 0.75 | 0.8 | 0.8 | 0.65 | 0.3 | 0.3 | 1.6 | 2.60 | 3.8 |

We claim:

1. A surfactant composition for use as an emulsifier in water blended fuel mixture comprising:

a) 5-65% by weight of an ethoxylate of cashew nut shell liquid of the formula

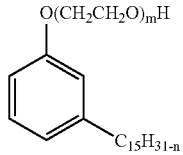

where m = 1-12 and n = 0, 2, 4 & 6;

b) 1-15% by weight of a cosurfactant having a hydrophilic lipophilic balance in the range of 4 to 12; and c) 15-50% by weight of a polymeric dispersant.

2. A surfactant composition as claimed in claim 1 comprising:

a) 46-50% by weight of an ethoxylate of cashew nut shell liquid;

b) 6-10% by weight of a cosurfactant having a hydrophilic lipophilic balance in the range of 4 to 12; and c) 15-50% by weight of a polymeric dispersant.

3. A surfactant composition as claimed in claim 2 comprising:

a) 50% by weight of an ethoxylate of cashew nut shell liquid;

b) 10% by weight of a cosurfactant having a hydrophilic lipophilic balance in the range of 4 to 12; and c) 40% by weight of a polymeric dispersant.

4. A surfactant composition as claimed in claim 1 wherein component 'a' is a mixture of compounds having m=1-8 and n=0, 2, 4 and 6.

5. A surfactant composition as claimed in claim 1 wherein said ethoxylates of CNSL includes ethoxylates of technical CNSL or hydrogenated CNSL or mixtures thereof.

6. A surfactant composition as claimed in claim 5 wherein said cosurfactant includes ethoxylates of alcohol, ethoxylated phenols, ethoxylated amines, ethoxylated fatty esters, glycol esters, mono diglyceride or monotriglycerides, ethoxylated fatty acids.

7. A surfactant composition as claimed in claim 6 wherein said cosurfactant is ethoxylates of alcohol and ethoxylated phenols.

8. A surfactant composition as claimed in claim 7 wherein said ethoxylates of alcohol is of the general formula $RO(CH_2CH_2O)_nH$ where R is hydrocarbon group having 6 to 18 carbon atoms and n is within a range from about 2.5 to about 12.

9. A surfactant composition as claimed in claim 8 wherein R is a straight chain aliphatic hydrocarbon group.

10. A surfactant composition as claimed in claim 8 wherein n ranges between 2.5 to 7.

11. A surfactant composition as claimed in claim 5 wherein the molecular weight of said exthoxylates is between 280-590.

12. A surfactant composition as claimed in claim 1 wherein said polymeric dispersant is a reaction product of an acetylating agent and an amine.

13. A surfactant composition as claimed in claim 12 wherein said acetylating agent includes carboxylic acids, acid halides, anhydrides and esters.

14. A surfactant composition as claimed in claim 13 wherein said acetylating agent is dicarboxylic acids and their anhydrides.

15. A surfactant composition as claimed in claim 12 wherein said acetylating agent has an alkyl substitution of about 1-250 carbon atoms.

16. A surfactant composition as claimed in claim 15 wherein alkyl substitution of said acetylating agent is derived from alpha olefins, polyisobutene.

17. A surfactant composition as claimed in claim 12 wherein said amine is ethylene polyamine.

18. A surfactant composition as claimed in claim 12 wherein said polymeric dispersant is polyisobutene succinimide.

19. A water fuel emulsified composition comprising:

55-96% by weight of a hydrocarbon fuel in the gasoline-diesel range;

1-35% by weight of water; and

.05-27% by weight of a surfactant composition and the balance of any additives comprising at least one of cetane booster, and corrosion inhibitor, with the surfactant composition comprising a) 5-65% by weight of an ethoxylate of cashew nut shell liquid of the formula

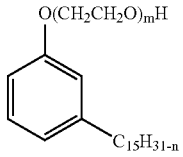

where m = 1-12 and n = 0, 2, 4 & 6, b) 1-15% by weight of a cosurfactant having a hydrophilic lipophilic balance in the range of 4 to 12, and c) 15-50% by weight of a polymeric dispersant.

20. A water fuel emulsified composition as claimed in claim 19 comprising:

88% by weight of a hydrocarbon fuel in the gasoline-diesel range;

10.4% by weight of water; and 1.6% by weight of a surfactant composition comprising a) 5-65% by weight of an ethoxylate of cashew nut shell liquid of the formula

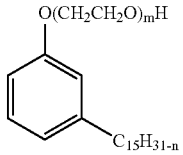

where m = 1-12 and n = 0, 2, 4 & 6, b) 1-15% by weight of a cosurfactant having a hydrophilic lipophilic balance in the range of 4 to 12, and c) 15-50% by weight of a polymeric dispersant.

21. A water fuel emulsified composition as claimed in claim 20 comprising:

81.8% by weight of a hydrocarbon fuel in the gasoline-diesel range;

16.2% by weight of water; and

2% by weight of a surfactant composition comprising a) 5-65% by weight of an ethoxylate of cashew nut shell liquid of the formula

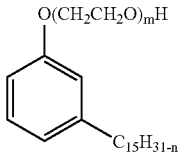

where m = 1-12 and n = 0, 2, 4 & 6;

b) 1-15% by weight of a cosurfactant having a hydrophilic lipophilic balance in the range of 4 to 12; and c) 15-50% by weight of a polymeric dispersant.

22. A water fuel emulsified composition as claimed in claim 20 wherein said cetanebooster is organo nitrates.

23. A water fuel emulsified composition as claimed in claim 20 wherein said corrosion inhibitor is mercapto thiadiazole derivatives.

* * * * *